United States Patent [19]

Hafner et al.

[11] Patent Number: 4,678,124

[45] Date of Patent: Jul. 7, 1987

[54] ELECTROMAGNETICALLY ACTUATABLE VALVE IN PARTICULAR A FUEL INJECTION VALVE

[75] Inventors: Udo Hafner, Lorch; Waldemar Hans; Wilhelm Kind, both of Bamberg; Rudolf Krauss, Stuttgart; Rudolf Sauer, Benningen, all of Fed. Rep. of Germany

[73] Assignee: Robert Bosch GmbH, Stuttgart, Fed. Rep. of Germany

[21] Appl. No.: 851,906

[22] Filed: Apr. 11, 1986

Related U.S. Application Data

[63] Continuation of Ser. No. 674,729, Nov. 27, 1984, abandoned, which is a continuation of Ser. No. 415,116, Sep. 7, 1982, abandoned.

[30] Foreign Application Priority Data

Nov. 5, 1981 [DE] Fed. Rep. of Germany ..... 3143848

[51] Int. Cl.[4] ..... B05B 1/30; F02M 51/00

[52] U.S. Cl. ..... 239/585; 239/600

[58] Field of Search ..... 239/585, 600

[56] References Cited

U.S. PATENT DOCUMENTS

| | | | |
|---|---|---|---|
| 3,567,135 | 3/1971 | Gerbert | 239/585 |
| 4,203,554 | 5/1980 | Zimmer et al. | 239/585 |
| 4,356,980 | 11/1982 | Krauss | 239/585 |
| 4,360,164 | 11/1982 | Bellicardi et al. | 239/585 |
| 4,365,747 | 12/1982 | Knapp et al. | 251/139 X |
| 4,399,944 | 8/1983 | Krauss et al. | 239/585 |
| 4,416,423 | 11/1983 | Krauss et al. | 239/585 |
| 4,423,841 | 1/1984 | Palma | 239/585 |
| 4,483,484 | 11/1984 | Hafner et al. | 239/585 |

*Primary Examiner*—Andres Kashnikow
*Assistant Examiner*—Kevin Patrick Weldon
*Attorney, Agent, or Firm*—Edwin E. Greigg

[57] ABSTRACT

An electromagnetically actuatable valve, in particular a fuel injection valve for fuel injection systems, which serves to supply fuel to internal combustion engines. The fuel injection valve comprises a valve chamber and a core upon which a magnet coil is wound by use of a carrier body. A flat armature is constructed in such a manner at its side facing core that it partially overlaps the front surface of a ferromagnetic valve chamber with its outer range of action so that the magnet circuit is guided to the flat armature via valve chamber and the front face and so that magnetic coil, when actuated, simultaneously serves as a detent for the flat armature.

4 Claims, 2 Drawing Figures

ELECTROMAGNETICALLY ACTUATABLE VALVE IN PARTICULAR A FUEL INJECTION VALVE

This is a continuation of application Ser. No. 674,729 filed Nov. 27, 1984, now abandoned which is a continuation of application Ser. No. 415,116 filed Nov. 7, 1982, now abandoned.

BACKGROUND OF THE INVENTION

The invention is directed to a fuel injection valve having a valve chamber in which a magnetic coil wound upon a ferromagnetic core is disposed and having a flat armature for actuating a movable valve component with relation to a valve seat. There are valves already known which utilize a flat armature which operates in conjunction with a shell-type core. However, generally such construction introduces higher costs of assembly into the manufacturing process thereby escalating production costs.

OBJECTS OF THE INVENTION

It is a principal object of the invention to provide a novel valve structure in which the cost of assembly is reduced.

It is a further object of the invention to maintain the performance of the electromagnetic valve while simplifying the design of the valve.

It is a still further object of the invention that the magnetic element be guided through the valve chamber proximate to the flat armature where the face of the valve chamber serves as a stop for the flat armature.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
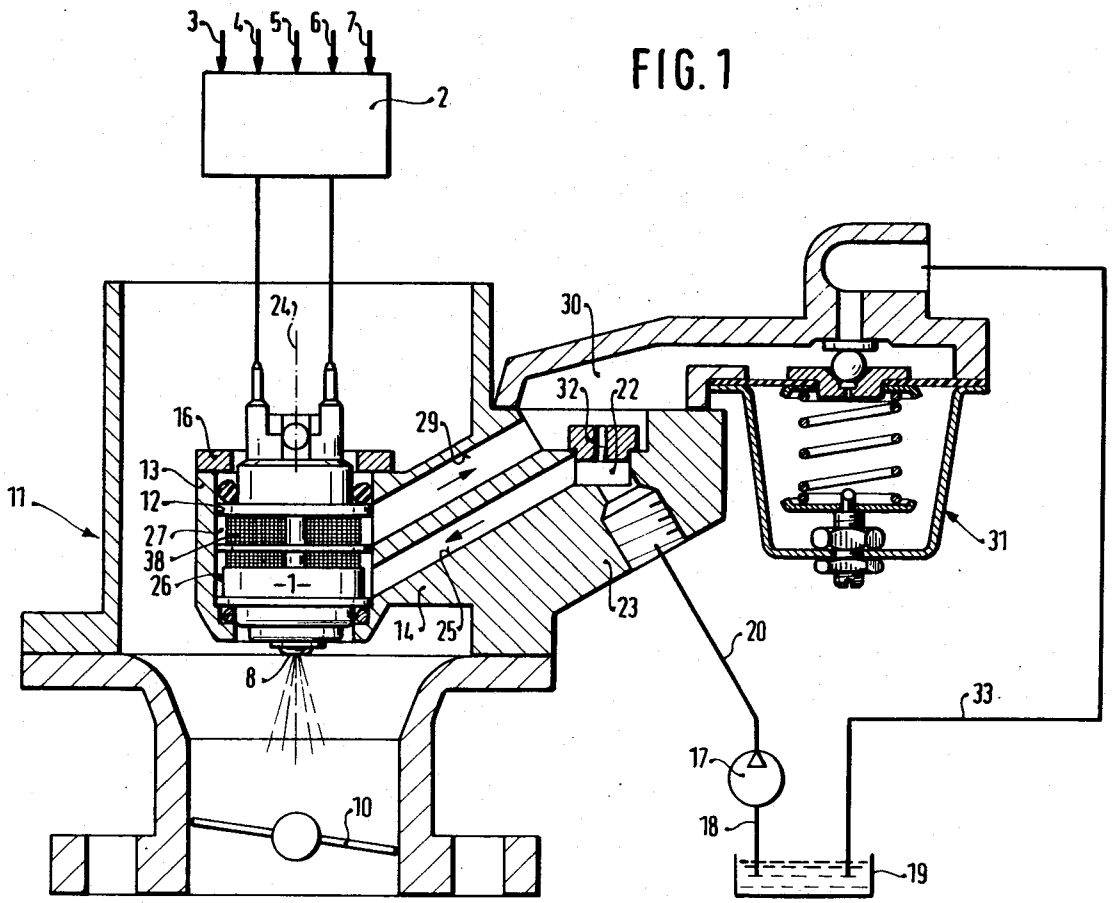
FIG. 1 is a simplified illustration of the preferred embdoiment of the invention, which is described in detail below, showing a fuel injection system with a fuel injection valve which is located in the air intake tube of an internal combustion engine.

The fuel injection system shown in FIG. 1 has a fuel injection valve 1, which is electromagnetically actuatable in a known manner by means of an electronic control unit 2 in accordance with operating characteristics of the internal combustion engine, such as rpm 3, aspirated air quantity 4, throttle valve position 5, temperature 6, exhaust gas composition 7 and others. This fuel injection valve 1 serves to inject fuel via an outlet 8, in particular at low pressure, into the air intake tube 11 of mixture-compressing internal combustion engines having externally supplied ignition. The injection of fuel by the fuel injection valve may be effected simultaneously for all of the cylinders of the engine into the air intake tube 11, either upstream or downstream of a throttle valve 10. In the exemplary embodiment shown in FIG. 1, the fuel injection valve 1 is supported upstream of the throttle valve 10 in a guide opening 12 of a holder body 13, which is disposed in the interior of the air intake tube 11 coaxially with this tube 11 and is connected via at least one holder strut 14 with the air intake tube 11, so that the holder body 13 is surrounded at least in part by a flow of the aspirated air. A claw or a cap fixed the fuel injection valve 1 in its axial position in the holder body 13.

For supplying to the fuel injection valve 1, a fuel supply pump 17, which may be driven by an electric motor, pumps fuel out of a fuel container 19 via an air intake line 18 into a fuel feed line 20, which discharges into a deaeration chamber 22. The deaeration chamber is embodied by way of example in a thickened portion 23 of the air intake tube 11. The fuel feed line 20 advantageously discharges into the deaeration chamber 22 such that it is directed upward and inclined toward the deaeration chamber 22; however, it is also possible for the fuel feed line 20 to extend horizontally toward the deaeration chamber 22 into which it discharges. A fuel supply line 25 which is inclined relative to the longitudinal axis 24 of the fuel injection valve 1 and extends downward toward the fuel injection valve leads from the deaeration chamber 22 to a circumferential groove 26 between a portion of the outer circumference of the fuel injection valve 1 and the guide opening 12 in the holder body 13. The outlet of the fuel supply line 25 at the circumferential groove 26 is thus located at a lower level than is its initial portion at the deaeration chamber 22.

From the circumferential groove 26, the fuel passes through openings (not shown) in the wall of the fuel injection valve into the interior of the fuel injection valve and is ejected in part via the outlet 8, while another part of the fuel passes through the interior of the fuel injection valve and passes to the outside, via openings (not shown) in the wall of the fuel injection valve, into a circumferential groove 27, which is embodied between the circumference of the fuel injection valve 1 and the guide bore 12 and is separate from the circumferential groove 26. A fuel return line 29 leads upward from the circumferential groove 27, being inclined with respect to the longitudinal axis 24 of the fuel injection valve 1; this fuel return line discharges at its highest point into a regulating chamber 30 of a pressure regulating valve 31. Thye fuel return line may extend parallel to the fuel supply line 25 and the two lines 25 and 29 may both be provided in the holder strut 14. As a result of the upwardly inclined course of the fuel return line 29, a rapid removal of vapor bubbles which may have formed in the fuel injection valve is assured. The deaeration chamber 22 communicates via a deaeration nozzle 32 with a point of the fuel return line 29 which is located at as high a level as possible, or with the regulating chamber 30. As a result, vapor bubbles are already removed and carried away from the supplied fuel at a safe distance from the fuel injection valve. The cross section of the deaeration nozzle 32 is selected by way of example such that approximately 2% of the quantity of fuel flowing back via the pressure regulating valve 31 into a return flow line 33 and to the fuel container 19 flows via the deaeration nozzle 32.

Figure 2:
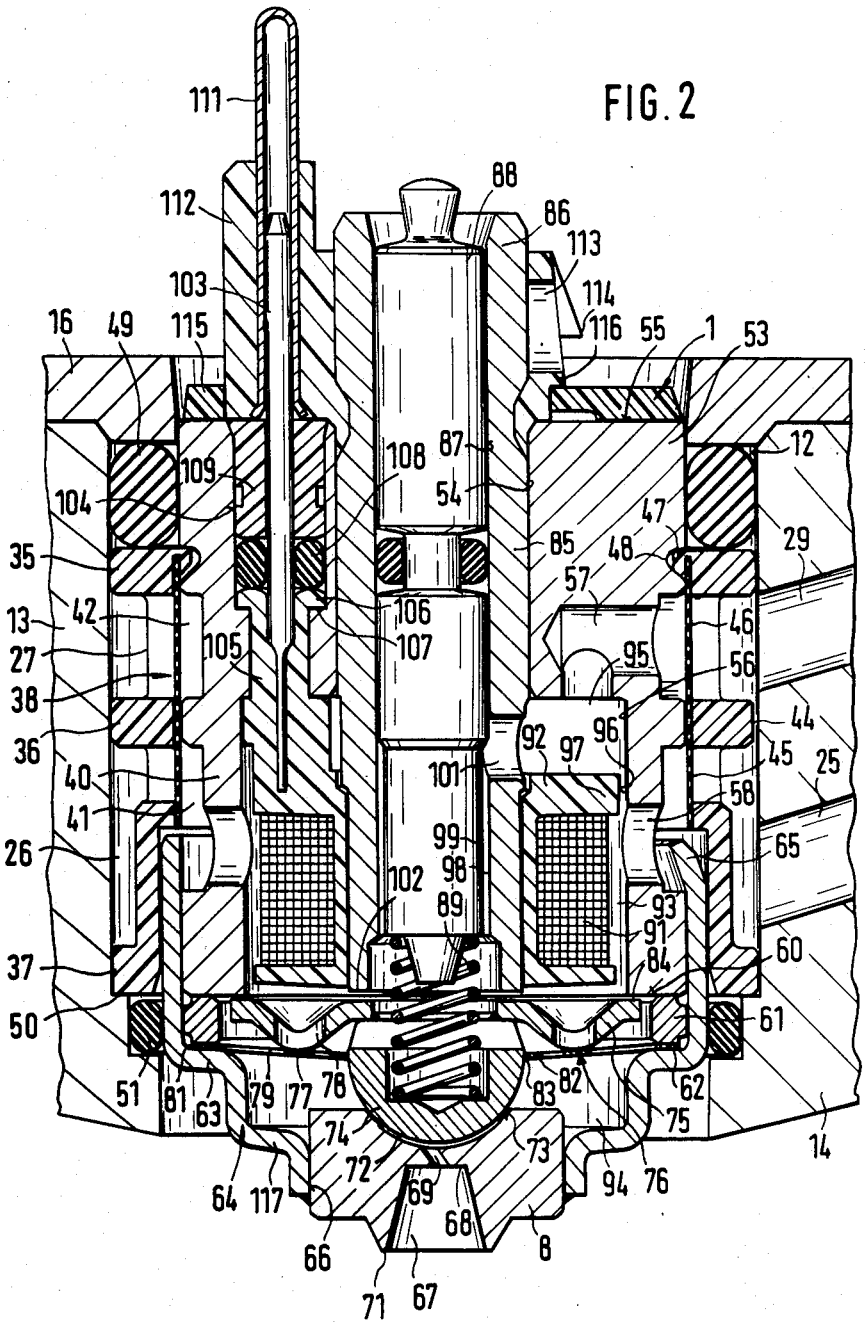
FIG. 2 is a cross-sectional view of a fuel injection valve in accordance with the preferred embodiment of the invention.

The fuel injection valve 1 shown in FIG. 2 is secured in a radial direction in guide opening 12 of holder body 13 thorugh the elastic supporting elements 35, 36, 37 of fuel sieve 38 which extends in the axial direction to cover the mouth of fuel supply line 25 and that of fuel return line 29. Circumferential groove 27 is defined in the axial direction by elastic supporting elements 35 and 36 while circumferential groove 26 is defined in the axial direction by elastic supporting elements 36 and 37. Elastic supporting elements 35, 36, 37 comprise an elastic material such as rubber or synthetic. The medial elastic supporting element 36, in particular, is ring-shaped so that it is, at the circumference of valve chamber 40, provided axially between a fuel feed groove 41 and fuel return groove 42 and laterally between guide opening 12 and valve chamber 40, so that it seals fuel feed groove 41 and fuel supply line 25 with circumferential groove 26 against fuel removal groove 42 and fuel return line 2 with circumferential groove 27. In order to remove the vapor bubbles which may be container in the fuel, a throttling deaeration channel 44 is provided between the circumference of medial elastic supporting element 36 and the wall of guide opening 12 to permit a flushing out of vapor bubbles from circumferential groove 26 to circumferential groove 27; the throttling channel 44 extends only over a limited circumferential distance about the medial elastic suppor5ing element 36. The deaeration channel could alternatively, which is not shown, be provided either in the wall of guide opening 12 or between the circumference of valve chamber 40 and medial elastic supporting element 36. The fuel flowing through fuel supply line 25 initially arrives at circumferential groove 26 and flow thorugh sieve 45 into a fuel feed groove 41 which is provided in valve chamber 40. From a fuel removal groove 42, which is likewise provided in valve chamber 40, the fuel flows via a sieve 46 into circumferential groove 27 and subsequently into fuel return line 29. Any dirt particles contained in the fuel are filtered out through the sieves 45, 46. The upper elastic supporting element 35, on its side which faces valve chamber 40, may be supplied with a detent 47 which, when gliding fuel sieve 38 onto the valve chamber 40, catches in adjusting groove 48 of the valve chamber of that fuel injection valve 1 may be inserted into guide opening 12 of holder body 13 together with the fuel sieve. A sealing ring 49 may be supported axially on the upper elastic supporting element 35 which is arranged between valve chamber 40 and holder body 13. The ring is further fixed by cap 16. The axial position of fuel injection valve 1 is further defined by the lower elastic supporting element 37 which is supported by a shoulder 50 of guide opening 12. Another sealing ring 51 is disposed near the lower elastic supporting element 37 at the circumference of fuel injection valve 1.

Valve chamber 40 is cup-shaped in design and includes an aperture 54 in the base of shell 53 which leads from the outer face 55 in the base of shell 53 to an interior bore 56. At least one fuel return opening 57 leads form the interior bore 56 via the wall of valve chamber 40 to fuel return groove 42 and at least one fuel feed opening 58 leads to fuel feed groove 41. A guiding membrane 62 is attached to a spacer ring 61 which is provided against the face 60 which is turned away from bottom of shell 53. Guiding membrane 62 also abuts a shoulder 63 of nozzle carrier 64 which partially encompasses valve chamber 40. Nozzle carrier 64 includes an end 65 which is rolled into fuel feed groove 41 so that an axial tension is provided to fix the positions of spacer ring 61 and guiding membrane 62. Opposite from valve chamber 40, nozzle carrier 64 forms a coaxial intake bore 66 in which nozzle outlet 8 is secured, for example, by welding or soldering. The nozzle outlet 8 includes a processing bore 67 advantageously provided in the shape of a truncated cone. At least one fuel-measuring guide bore 69 discharge into base 68 of processing bore 67. The fuel bore 69 discharges in such a manner at the base 68 that no tangentially directed inflow into processing bore 67 ensues; rather the fuel stream first exits freely via fuel guide bore 69 without touching the walls. Afterwards the fuel stream hits the wall of processing bore 67 in order to form a film somewhat in the shape of a parabola, and then flow outwardly and break away into open end 71. The fuel guide bore 69 is inclined with respect to the valve axis and originates from a cup 72 which is provided in nozzle outlet 8, upstream from which is dished valve seat 73 is also provided in nzozzle outlet 8. A valve component 74, spherical in shape, works together with the valve seat 73. To attain a minimal clearance volume, the volume of cup 72 should be as small as possible between the valve component 74 and the dished valve seat 73.

Opposite valve seat 73, valve component 74 is joined with a flat armature 75 by soldering or welding. The flat armature 75 may comprise a stamped or molded metal piece. It may, for example, include a ring-shaped guiding ring 76 which is elevated and lies against a spherically shaped guiding area 77 of guiding membrane 62 on the side of the guiding membrane 62 which is opposite from valve seat 73. Flow openings 78 is flat armature 75 and current clearances 79 in guiding membrane 62 permit an unrestricted flow of fuel to surround both flat armature 75 and guiding membrane 62. Fixed guiding membrane 62 is, at its outer circumference, firmly secured between spacer ring 61 and shoulder 63 at a clamping area 81 and is provided with a centering area 82 which encompasses a centering opening 83 through which the movable valve component 74 rises and is centered in a radial direction. The strong clamping force of guiding membrane 62 between spacer ring 61 and shoulder 63 extends inwardly to the valve component 74 lying against the valve seat 73, through the center, or as close as possible to the center, of the spherically shaped valve component. Via guiding area 77 of guiding membrane 62, which is located at guide ring 76 of flat armature 75, the flat armature 75 is pressed as parallel as possible to face 60 of valve chamber 40, which chamber the flat armature 75 partially overlaps with an outer extremity indicated as 84.

A tubular-shaped core 85 is inserted into the aperture 54 in the base of shell 53. The core 85 extends through the valve and adjacent to flat armature 75. The core 85 also is provided with a connection piece 86 formed out of the valve chamber which projects exteriorly of the valve. A gate valve 88 is pressed or screwed into a support bore 87 within core 85 in abutment with a pressure spring 89, which spring is seated in a bore provided in valve component 74; and the spring tends to urge valve component 74 in the direction of valve seat 73. A carrier body 92 for a magnetic coil 91 is arranged on core 85 within the inner bore 56 of valve chamber 40. The incoming fuel which flows through fuel supply openings 58, approximately at the level of the carrier body 92, enters a flow passage 93. The flow passage 93 is provided between the circumference of magnetic coil 91 and the carrier body 92 within bore 56. From flow passage 93, the fuel proceeds unthrottled to a collecting chamber 94 surrounding both valve seat 73 and component 74. Opposite from flat armature 75, carrier body 92, like the base of shell 53, borders an outflow area 95 with which flow passage 93 communicates by way of a first restriction 96. The first restriction 96 may advantageously be provided through the annular gap between the circumference of a wall 97 of carried body 92 and a wall of bore 56. The first restriction 96 could, however, also be provided directly in the wall of bore 56 or in the wall 97. The arrangement of first restriction 96 proves particularly advantageous in that vapor bubbles which collect in flow passage 93 may directly flow into outflow area 95 without first being transported into collecting chamber 94 with the fuel. The outflow area 95 communicates with the fuel return openings 57 so that the vapor bubbles may be flushed out of outflow area 95 with the excess fuel returning into fuel return line 29.

A ring-shaped second restriction 98 is provided between the circumference of gate valve 99, which faces flat armature 75, and the wall of bore 87 within core 85. The second restriction 98 likewise communicates via at least one radial bore 101 with outflow area 95 and likewise enables the vapor bubbles close to valve component 74 to be flushed out into return fuel line 29.

The core 85 is advantageously pushed into valve chamber 40 so far that between a face 102, which lies adjacent flat armature 75, and flat armature 75 itself, another small gap is provided when magnetic coil 91 is actuated and the flat armature, with its outer extremity 84, comes to abut against the face 60 of valve chamber 40. When magnetic coil 91 is unactuated, the flat armature assumes a position in which an air gap is likewise formed between face 60 and outer extremity 84. Affixation of the flat armature to the core is thereby avoided. Upon assembly, after the adjustment of the requisite air gap, core 85 advantageously becomes soldered or welded with the base of shell 53. The magnetic circuit extends outward over the valve chamber 40, inward over core 85, and to flat armature 75. While core 85 and flat armature 75 are made of high quality low-retentivity material, the valve chamber 40 may be made from a less costly material such as free-cutting steel. With an actuated magnetic coil 91, the dynamic effect on flat armature 75 ensues, for the most part, over core 85. In order to heighten the dynamic effect on flat armature 75 via face 60 of valve chamber 40, valve chamber 40 could likewise be made of low-retentivity material.

The current supply to magnetic coil 91 proceeds over contact lugs 103 which are partially inserted into the synthetic carrier bodies 92 and which also project beyond the base of shell 53 via the contact openings 104 in the base of shell 53. The carrier body 92 may include retaining attachments 105 which respectively partially surround a contact lug and extend into a connecting opening 104 where they are fixed in axial direction to an attachment 107 of connecting openings 104 by means of a ring-shaped hot rivet 106. For the purpose of sealing, the contact lug 103 is arranged to extend through a sealing ring 108 in the connecting opening 104 and an adjoining sleeve 109. In order to obtain standardized plug connections, a contact sleeve 111 is inserted into each contact lug 103 protruding from valve chamber 40 and is welded or soldered to it. In this manner, the diameter of contact lugs 103 may be minimized resulting in smaller connecting openings 104 which are easier to seal. Contact sleeves 111 and end-piece 86 may subsequently be partially sprayed with a synthetic coating 112. The two bores 113 across from end-piece 86 remain untouched by the synthetic spray coating. A tool is used to squeeze the end-piecde 86 in a radial direction after gate valve 88 has been pushed so far into support bore 87 that the force of pressure spring 89 is biased the desired amount, and thus the amount of the dynamic buel injection is thereby deteremined.

A spout 114 protruding through the coating of synthetic 112 may for example serve to fasten an electric plug (not shown) which connects contact sleeves 111 with the electronic control unit 2. A synthethic disc 115 may be slid over the synthetic spray coating 112. This disc lies against face 55 at the base of shell 53 where it is locked in by a detent 116 in the synthetic spray coating 112. Varied coloring of the synthetic disc or certain data displayed on its surface serves to identify the type of fuel injection valve. For the adjustment of the static quantity of flow, the nozzle carrier 64 may have a range of distortion 117 which is plastically moldable in the axial direction of the valve. Thus, nozzle outlet 8 may be shifted with valve seat 73 more or less in the direction of valve component 74.

The injection valve according to the invention is advantageous in that it is small in size and can be constructed at reasonable cost, and yet, by positioning the magnetic field over the valve chamber 40 and with relation to the flat armature 75 as described, the outer extremity 84 of the flat armature 75 permits a supplementary power effect on the flat armature.

The foregoing relates to a preferred exemplary embodiment of the invention, it being understood that other embodiments and variants thereof are possible within the spirit and scope of the invention, the latter being defined by the appended claims.

What is claimed and desired to be secured by letters patent of the United States is:

1. An electromagnetically actuable fuel injection valve for a fuel injection system of an internal combustion engine comprising a holder body (13), including a valve chamber, a shell (53) having an upper base (55) and a bottom face (60) disposed in said holder body valve chamber, whereby said upper base is arranged at one end of said shell and said bottom face is arranged at the opposite end of said shell, an axial aperture (54) in said base of said shell which leads from an outer face (55) on said base of said shell to an inner face of said base, an axial interior bore (56) of substantially uniform diameter in said shell that extends from said base to said bottom face and having a greater diameter than said axial aperture, a nozzle carrier coaxial with said shell and shell holder body (valve chamber) with an axially directed extension that extends into said holder body and surround a portion of said shell and said bottom face of said shell, a spacer ring secured between said bottom face of said shell within said nozzle carrier extension and a shoulder on said nozzle carrier juxtaposed said bottom face of said shell, a guiding membrane secured between said shoulder on said nozzle carrier and said spacer ring and pressed against said spacer ring and said shoulder of said nozzle carrier, a tubular shaped core made of ferro-magnetic material that is inserted in said aperture in said shell and extends through the interior bore (56) in a direction to said bottom face of said shell, a magnetic coil wound about said core of ferro-magnetic material and disposed within said valve chamber, a substantially flat armature arranged in coaxial alignment with said magnetic coil juxtaposed an end of said core, a valve component secured to said armature coaxial therewith and movable thereby, a nozzle coaxially supported by said nozzle carrier, a dished valve seat formed on said nozzle in coaxial alignment with said valve component for reception thereof, said substantially flat armature includes a circumferential extremity which overlaps a portion of a bottom face of said shell, said substantially flat armature assumes a normal first position spaced away from said portion of said bottom face of said shell whereby a first air gap is provided in said first position when said valve is closed, and a second position in which said circumferential extremity of said armature is in abutment with said overlapped portion of said bottom face of said shell upon actuation of said magnetic coil to open said valve.

2. A valve as defined by claim 1, in which a second air gap is provided between a front face of said core and said flat armature when said flat armature assumes said second position abutting said bottom face of said shell.

3. A valve as defined by claim 2, in which said guiding membrane is fixed at an outer circumference relative to said shell to guide said flat armature parallel to the bottom face of said shell and parallel to the front face of said core.

4. A valve as defined in claim 3, in which said guiding membrane is arranged to orient the flat armature and the valve component radially.

* * * * *